US005295692A

United States Patent [19]

Wright

[11] Patent Number: 5,295,692

[45] Date of Patent: Mar. 22, 1994

[54] BOWHUNTING ARROW

[76] Inventor: Barry M. Wright, 9906 Perry Rd., Le Roy, N.Y. 14482

[21] Appl. No.: 61,232

[22] Filed: May 17, 1993

[51] Int. Cl.[5] ..... F42B 6/04
[52] U.S. Cl. ..... 273/416
[58] Field of Search ..... 273/416–423

[56] References Cited

U.S. PATENT DOCUMENTS 1,999,601 4/1935 Tengel ..... 273/416

FOREIGN PATENT DOCUMENTS 3155880 7/1991 Japan .

OTHER PUBLICATIONS

Teflon Coated Arrow Jan 1972.

*Primary Examiner*—Paul E. Shapiro
*Attorney, Agent, or Firm*—Robert J. Bird

[57] ABSTRACT

A hunting arrow includes a shaft with a thin outer coating of an elastomeric material for silent draw and release of the arrow. The coating is preferably of a self lubricating material, with a non-reflective matte surface.

3 Claims, 1 Drawing Sheet

BOWHUNTING ARROW

FIELD OF THE INVENTION

This invention relates to bowhunting arrows, and more particularly to an improvement to render the arrow silent as it is drawn.

BACKGROUND INFORMATION

Bowhunting is a popular form of deer hunting and the key to a successful hunt is keeping quiet in the woods. Due to the nature of the weapon, the bowhunter must shoot from close range, and the closer the range, the more likely it is that the deer will hear the slightest noise made by the hunter. This is well known, and has been addressed in the past by the use of quiet clothing and by various attempts to eliminate noise from equipment.

The typical bowhunting arrow has a shaft of aluminum or other hard material. As the hunter draws the arrow, and then releases it, the sliding movement of an aluminum arrow shaft on the metal surface of an arrow rest produces noise which is audible to deer. Hunting literature tells of deer that were spooked and got away because of the sound of an arrow sliding on its rest. Leather, moleskin, Teflon, or other plastic coating on metal parts of the arrow rest are devices which have been used to prevent or soften these metal-on-metal sounds. These solutions are not entirely satisfactory. The materials or coatings are subject to wear, with resulting continuing change of the performance characteristics of the bow. Also, because of the wear, they have to be removed and replaced periodically.

It is an object of this invention to provide a bowhunting arrow which is inherently silent in use.

SUMMARY OF THE INVENTION

The present invention is a hunting arrow, including a shaft with a thin outer coating of an elastomeric material for silent draw and release of the arrow. The coating is preferably of a self lubricating material, with a non-reflective matte surface.

DRAWING

DESCRIPTION

Figure 1:
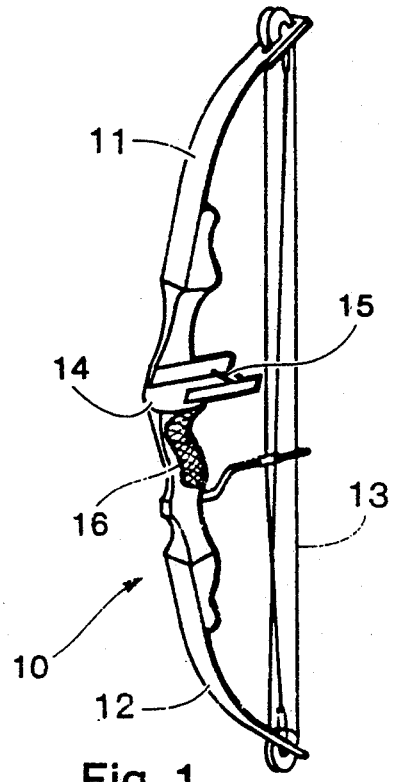
FIG. 1 is a three-dimensional view of a typical hunting bow.
Figure 4:
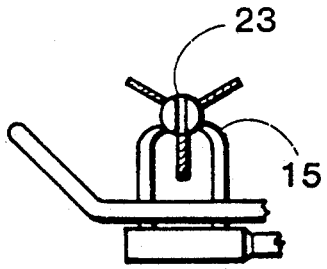
FIG. 4 is a rear view of an arrow sitting on a typical arrow rest.
Figure 2:
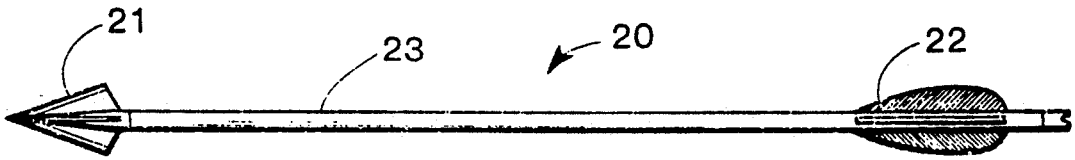
FIG. 2 is a side view of an arrow of the present invention.
Figure 3:
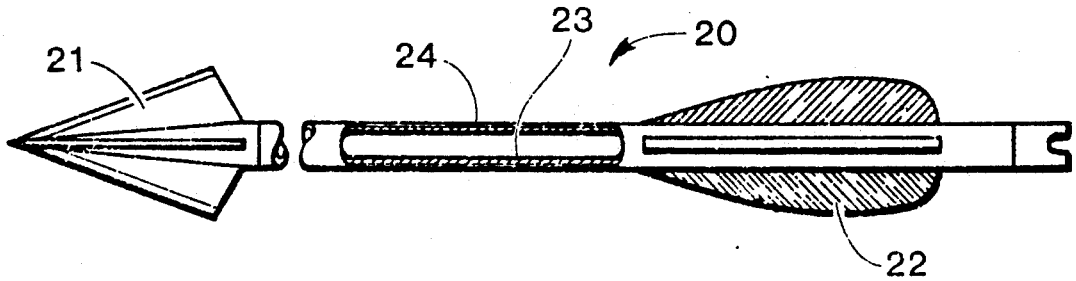
FIG. 3 is an enlarged side view similar to FIG. 2, partially in section.

In the drawing, a bow 10 includes upper and lower limbs 11 and 12, a bowstring 13, a shelf 14, an arrow rest 15, and a grip 16. An arrow 20 includes a head 21, tail 22, and shaft 23. The shaft 23 includes a thin outer coating 24. In use, the arrow shaft 23 sits on the arrow rest 15.

The arrow shaft coating 24 is of an elastomeric material (i.e. a resilient, pliable rubber or plastic material) so that its movement on the arrow rest 15 does not produce an audible sliding sound when the arrow is drawn. The coating also prevents chattering or clicking as the arrow comes in contact with other parts of the bow or with other arrows in a quiver. The coating should be resilient and pliable, but not so soft as to be gummy or frictional. The coating is preferably self lubricating with a non-shiny matte surface so that it does not produce specular light reflection. Silicon rubber, with its pliability, water resistance, and self-lubricating characteristic is one suitable material for the shaft coating.

The draw and release of this arrow are so quiet as to be inaudible, or substantially inaudible, to anyone except the hunter himself. The mechanical sound commonly made by prior art arrows is eliminated.

As a deer approaches and moves within shooting range, the bowhunter will come to full draw at some distance from the animal so as to escape detection by sound or movement. With the silent arrow of this invention, the hunter can come to full draw later, with the animal closer, because the animal will not hear the draw. This shortens the time of holding the bow at full draw, reduces the hunter's fatigue, and enhances the accuracy of the shot.

The coated arrow eliminates the sliding sound of an arrow in its draw and release movements. It also eliminates the noise of the arrow chattering and clicking against various parts of the bow, or against other arrows while being drawn from a quiver. Finally, while the plain aluminum arrow causes wear on the arrow rest, the coated arrow does not wear on the arrow rest.

The foregoing description of a preferred embodiment of this invention, including any dimensions, angles, or proportions, is intended as illustrative. The concept and scope of the invention are limited only by the following claims and equivalents thereof.

What is claimed is:

1. A hunting arrow for use with a bow, said arrow including a head, a tail, and a shaft;

said shaft including an outer coating of an elastomeric material;

whereby movement of said arrow on said bow is substantially silent through the draw and release of said arrow.

2. A hunting arrow for use with a bow, said arrow including a head, a tail, and a shaft;

said shaft including an outer coating of an elastomeric material to permit substantially silent draw and release of said arrow on said bow;

said coating having a matte surface to prevent specular light reflection therefrom.

3. A hunting arrow as defined in claim 2 in which said coating is of a material with self-lubricating characteristic.

* * * * *